United States Patent [19]

Konrath et al.

[11] Patent Number: 4,563,996

[45] Date of Patent: Jan. 14, 1986

[54] FUEL INJECTION PUMP FOR INTERNAL COMBUSTION ENGINES

[75] Inventors: Karl Konrath, Ludwigsburg; Otmar Weiss, Stuttgart, both of Fed. Rep. of Germany

[73] Assignee: Robert Bosch GmbH, Stuttgart, Fed. Rep. of Germany

[21] Appl. No.: 651,666

[22] Filed: Sep. 17, 1984

[30] Foreign Application Priority Data

Oct. 11, 1983 [DE] Fed. Rep. of Germany ..... 3336870

[51] Int. Cl.[4] ..... F02M 59/20

[52] U.S. Cl. ..... 123/502; 417/462

[58] Field of Search ..... 123/502, 501, 179 L, 123/179 G; 417/462

[56] References Cited

U.S. PATENT DOCUMENTS

| | | | |
|---|---|---|---|
| 4,050,437 | 9/1977 | Hollett et al. | 123/504 |
| 4,098,249 | 7/1978 | Mowbray | 123/450 |
| 4,177,775 | 12/1979 | Hofer et al. | 123/502 |
| 4,397,284 | 8/1983 | Kaibara et al. | 123/502 |
| 4,406,268 | 9/1983 | Eheim et al. | 123/502 |

*Primary Examiner*—Magdalen Y. C. Moy

*Attorney, Agent, or Firm*—Michael J. Striker

[57] ABSTRACT

A fuel injection pump is provided with a device for adjusting the start of fuel injection which includes a turnable roller ring and a stop engaged in the roller ring and mounted on a shaft turnable by an actuating adjusting lever between two end positions. The stop is positioned eccentrically to the axis of the shaft. The stop limits the angle of twist of the roller ring to adjust the start of fuel injection.

3 Claims, 4 Drawing Figures

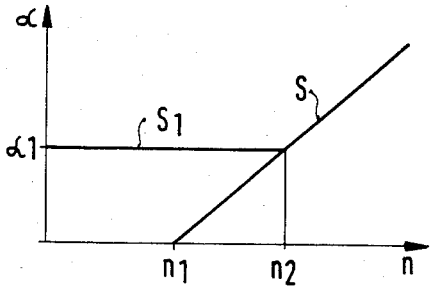
FIG.1
FIG. 2
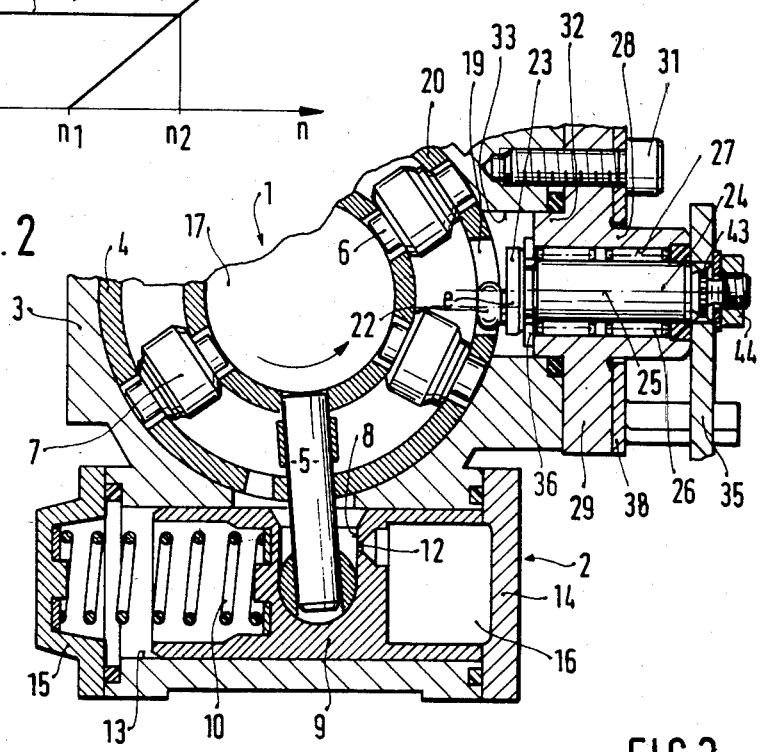
FIG.4
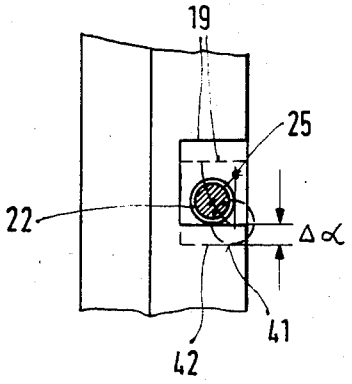
FIG.3
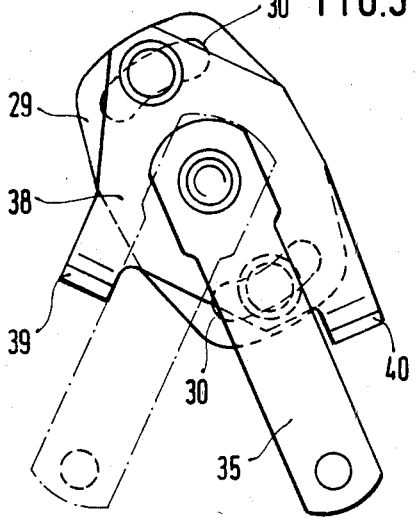

FUEL INJECTION PUMP FOR INTERNAL COMBUSTION ENGINES

BACKGROUND OF THE INVENTION

The present invention relates to a fuel injection pump for internal combustion engines, which includes a cam drive for actuating at least one pump piston and an injection adjusting or timing mechanism.

The German patent publication No. DE-OS 27 29 807 (U.S. Pat. No. 4,177,775) discloses a fuel injection pump in which the adjustment of the injection start to "early" is obtained for a cold engine and a warmed-up engine with the aid of a thermostat which is applied against the force of the restoring spring on the adjusting lever. The stop provided in the adjustment device acts in a recess formed in a roller ring, on which the rollers are uniformly distributed and on which a cam disc runs, which is interconnected between the drive and the pump piston. The shaft, with which the stop of the adjustment device is in connection, is supported in the known fuel injection pump in a sleeve bearing. The lever arm is positioned in the operative position between the stop and the axis with which the stop is adjusted somewhat perpendicular to the direction of adjustment of the roller ring so that a high torque is required for the adjustment. Considerable displacement forces which act in the known adjustment device must be overcome.

SUMMARY OF THE INVENTION

It is an object of the present invention to provide an improved fuel injection pump.

This and other objects of this invention are attained by a fuel injection pump for internal combustion engines, comprising a housing; a cam drive including at least one roller running on a circular cam track, a pump piston, said cam drive effecting a conveying stroke of said pump piston, said cam drive including one portion which carries said at least one roller and is rotated by a drive of fuel injection pump, and another portion which is stationary in a direction of a cam elevation and is ring-shaped in a direction of a cam track circumference, said housing including a circular recess in which said another portion is positioned; an adjustment mechanism adapted to be rotated relative to said another portion for changing an injection start, said another portion being formed with a recess, said adjustment mechanism including an adjusting lever, a shaft positioned in said housing and connected to said lever and having an axis, and a stop engaged in the recess of said another portion and connected to said shaft, said stop being arranged eccentrically to said axis to form a lever arm, said adjustment mechanism further including an injection adjustment piston connected to said another portion of the cam drive and adjustable in dependence on the speed of the pump; said adjustment mechanism further including a sleeve having a bore, a roller bearing positioned in said bore and supporting said shaft, said housing having a wall formed with a circular recess, said sleeve having a cylindrical portion received in the circular recess of said wall, said cylindrical portion having an axis extending eccentrically with the axis of the shaft, fixing means for connecting said sleeve to the wall of said housing in a respective rotational position of the sleeve, at least one limiting stop member which defines such a rotational position of said shaft in which said lever arm is in alignment with a circumferential direction of said another portion of said cam drive.

The roller bearing may be a needle bearing which has an outer ring pressed in said sleeve, said shaft forming an inner ring of said needle bearing.

The sleeve may have a flange formed with oblong openings, said fixing means including bolts which are guided through said oblong openings, said bolts fixing said sleeve in said housing in an adjusted rotation position.

The pump may further include a plate formed with said limiting stop member, said plate being connected to said limiting stop member limiting at least one end position of said adjusting lever.

The plate may be mounted to the flange of said sleeve and is held on said flange by said bolts.

The chief advantage of the present invention resides in that the friction forces and restoring torques which act on the adjusting lever are substantially reduced as compared to those occurring in the conventional fuel injection pump. The restoring torques are specifically reduced due to the selection of the adjustment region of the stop which has only a very small lever arm acting in the restoring direction and which becomes ever smaller the closer it approaches its top dead center. The rotation of the stop up to its top dead center relative to the direction of adjustment of the aforementioned another portion of the cam drive (for example, cam ring) has the advantage that in this position the smallest holding forces are sufficient to maintain this adjustment position. Therefore a compensation for tolerances or the adjustability, by a turnability of the sleeve guiding the shaft and an eccentric support of the shaft relative to the axis of the sleeve, are possible in a simple fashion. The adjustment position can be easily and accurately controlled by the cooperation of the sleeve with one of the limiting stop members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a diagram showing the amount of adjustment according to a number of revolutions;

FIG. 2 is a cross-sectional view of the injection pump;

FIG. 3 is a top plan view of the adjusting lever; and

FIG. 4 is a side view of the roller ring shown in FIG. 2.

DETAILED DESCRIPTION OF THE PREFERRED EMBODIMENTS

As is known, the start of ignition of fuel into a Diesel engine and a further ignition process at pressure surges in a combustion chamber are determined in the region of the top dead center of the piston of the engine. In order to avoid high combustion noises the feed of fuel must be conducted so that a relatively uniform burning out of the mixture would take place in such a manner that no great peaks of pressure would occur before the dead center. The control of the injection time point at the delay of the ignition and the time of the ignition, which are required for the fuel to be ignited and burned out, must be taken into consideration. The ignition delay, as is known, depends upon temperatures of the fuel itself and also upon the temperature conditions of the environment. Since these times are practically constant the injection time point is shifted to "early" when the number of revolutions of the Diesel internal combustion engine is increased. Inasmuch as the ignition delay, specifically in a cold internal combustion engine, is very long it has been advantageous to shift the injection start to "early" already during the start-up of the internal combustion engine and at the low number of revolutions. This "early" injection point in time would cause a shifting forward of a combustion peak pressure in the warmed-up internal combustion engine before the top dead point is reached, which, as is known, has some disadvantages. The shifting of time point to "early" is favorable for the start in order to obtain a fast running-up of the internal combustion engine.

FIG. 1 of the drawings shows the relationship between the adjustment amounts and the speed of the machine. The injection adjustment angle $\alpha$ is plotted over the ordinate, and the speed is plotted over the abscissa. The curve S linearly rises as the number of revolutions is increased from $n_1$ to $n_2$. Characteristic $S_1$ for the injection adjustment shows that angle $\alpha_1$ in the region of the warmed-up running remains constant over a number of revolutions unless it reaches a point of intersection with the curve S, at which the injection adjustment angle $\alpha$ is adjusted to "early" at the increased number of revolutions. Curve S corresponds to the injection adjustment at normal operating temperature of the internal combustion engine whereas curve $S_1$ corresponds to the adjustment of the injection time point to "early" independently from the number of revolutions of the pump, which can be obtained by the arrangement according to the invention.

The fuel injection pump, with which the above described curve can be realized is illustrated in FIG. 2. FIG. 2 shows a partial sectional view through a distributor fuel injection pump in the region of the cam drive 1 and the injection adjustment mechanism 2. Only a housing 3 of the cam drive is partially shown in the drawing. A roller ring 4 is radially and axially guided in housing 3. Rollers 7 are positioned at a front side of the roller ring 4 in the known fashion. Axles 6 of rollers 7 are respectively inserted in an inner and outer ring of the roller ring 4. An adjusting pin 5 radially outwardly projects from the roller ring 4 and is connected thereto. The end of the adjusting pin 5 is received in a recess 8 of an injection adjusting piston 9 of the injection adjustment mechanism 2. The adjusting piston 9 is displaceable in a bore 13 of the adjustment mechanism 2. Bore 13 is enclosed at two sides by covers 14 and 15. The adjusting piston 9 has a work chamber 16 at one side of bore 13. Work chamber 16 is in communication with recess 8 through a throttle 12 formed in the adjusting piston 9 and with a pump suction chamber 17 through the recess 8. The pump suction chamber 17 is filled in the known fashion with fuel, the pressure of which depends on the number of revolutions of the pump but can be adjusted in dependence upon other parameters.

A restoring spring 10 is provided on the other side of adjusting piston 9 between the cover 15 and the front side of the piston. A hydraulic pressure of the fuel in the work chamber 16 acts against the restoring force of spring 10. As the number of revolutions of the pump increases the adjusting piston 9 is adjusted in the leftward direction and the roller ring is rotated against the direction indicated by the arrow or leftwardly.

The arrow in the drawing shows the direction of rotation of the cam disc (not shown) which runs on rollers 7; the cam disc is connected in the known fashion to the pump piston and is driven by the drive of the fuel injection pump synchronously with the number of revolutions of the internal combustion engine. If the roller ring 4 is rotated further in the left-hand direction then, the sooner the cams of the cam disc run on the roller 7 the sooner the feeding stroke of the pump piston and the injection start therewith will result.

A recess 19 is further provided in the roller ring 4, namely in its outer ring 20. This recess is also seen in FIG. 4. In the exemplified embodiment recess 19 is rectangular in shape. A stop 22 having the shape of a ball-like head extends into the recess 19. A disc or washer 23, which forms the end portion of a shaft 24, is connected to the stop 22. The diameter of disc 23 is greater than the diameter of shaft 24 and stop 22 is positioned axially eccentrically to central axis 25 of shaft 24 so that the eccentricity indicated by "e" forms a crank arm.

Shaft 25 is immediately supported on the rollers or needles of a needle bearing 26 and forms in a way an inner ring of the needle bearing 26. The latter is inserted, for example pressed, in a bore 27 of a sleeve 28 which has a flange 29 formed with two diametrally opposing oblong holes 30, through which fastening bolts 31 extend. Fastening bolts 31 guided in respective oblong holes 30 are screwed into housing 3 of the fuel injection pump. Sleeve 28 further has a cylindrical portion 32 which is inserted into a cylindrical recess 33 formed in the pump housing. The central axis of recess 33 is parallel to that of bore 27 but these recesses are formed with a predetermined eccentricity.

An adjusting lever 35 is secured on the end of shaft 24, extended outwardly from sleeve 28. Adjusting lever 35 together with the disc or washer 23 with the interposition of a protection washer 36 between the washer 23 and needle bearing 26 axially secures shaft 24. A plate-like element 38 is mounted to the flange 29 of sleeve 28. Plate 38 has two diametrally opposing bores, as shown in FIG. 3, through which fastening bolts 31 are guided. The plate-like element 38 is secured in its angular rotation position by means of the fastening bolts 31. This element 31 has two projecting lugs which form limiting stops 39 and 40, into contact with which adjusting lever 35 can be brought.

The operation of the fuel injection pump according to the invention is as follows:

The adjustment of the injection time point is obtained by means of the injection time adjustment mechanism 2 in dependence upon the number of revolutions of the pump and thus the engine in accordance with curve S depicted in FIG. 1. If the engine is cold the lever 35 is rotated by the hand of the operator to the left and is brought into contact with the limiting stop 39 as shown in dash-dotted line in FIG. 3. The stop 22 is thereby also adjusted and moves to the position shown by dashed line in FIG. 4. In this position the point of contact 41 of stop 22 with the limiting edge 42 lying in the circumferential direction of roller ring 4 is in alignment with the central axis 25 in the circumferential direction or the direction of rotation of roller ring 4. In this position the restoring spring 10 of the injection adjustment mechanism 2 exerts no torque on shaft 24 so that the holding forces on adjusting lever 35 for the maintenance of this position of stop 22 are practically zero. This position now defines, however an earlier point in time of injection $\alpha_1$ in accordance with $S_1$ in FIG. 1 unless the number of revolutions of the internal combustion engine increases such that the injection adjusting piston 9 assumes the adjustment position at the point of intersection of curves $S_1$ and S when the number of revolutions of the engine is $n_2$. At this point the adjustment of the start of the ignition takes place in a usual manner. When the internal combustion engine is warmed-up the adjusting lever 35 is rotated in the counter direction back and the stop 22 is also pivoted in the backward direction. Then even smaller injection adjustment angles $\alpha$ are possible during the running of the engine in accordance with curve S.

Owing to the above-described fashion of the adjustment of the onset of the ignition the adjustment to "early" can be conducted easily by an operator of the engine and without the requirement of servo-control or complicated lever transmission arrangements. Friction forces which act against the rotation of shaft 24 are substantially reduced due to the supporting of the shaft on the roller or needle bearings, and further the lever arm "e" is held very small so that the stop in its position at the top dead center, which causes the "early" adjustment of the internal combustion engine in case of a cold engine, and of the warmed-up engine as well, is in relation with the direction of the adjustment of the roller ring. The effective lever arm "e" is further reduced within a small operative rotation range of shaft 24 of about 50° so that the stop travels along a circular path shortly before the top dead center, and a change in a rotation angle produces only a very small stroke.

Since in the arrangement according to the present invention the position of the dead center of stop 22 is provided as an end position the adjustment of the whole shaft 24 is necessary, which is possible due to its eccentric position relative to the cylindrical portion 32 of sleeve 28. This sleeve is adjusted along the oblong openings 30 after bolts 31 have been loosened, and sleeve 28 can be then fixed in a desired end position by bolts 31. The adjusting lever 35 is mounted on the end of shaft 24 by means of a toothing 43 and is held on that end by a nut 44. The coordination of adjusting lever 35 with the stop lug 39 can be adjusted by means of toothing 43. Thereby an accurate adjustment is ensured. The actuation of the adjusting lever can be obtained by a pulling cable, whereby no locking device in the work position of the adjusting lever is necessary for the aforementioned reasons.

It will be understood that each of the elements described above, or two or more together, may also find a useful application in other types of fuel injection pumps for internal combustion engines differing from the types described above.

While the invention has been illustrated and described as embodied in a fuel rejection pump for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying without omitting features that, from the standpoint of prior art, fairly constitute essential characteristics of the generic or specific aspects of this invention.

What is claimed as new and desired to be protected by Letters Patent is set forth in the appended claims:

1. A fuel injection pump for internal combustion engines, comprising a housing; a cam drive including at least one roller running on a circular cam track, a pump piston, said cam drive effecting a conveying stroke of said pump piston, said cam drive including one portion which is rotated by a drive of the fuel injection pump, and another stationary portion which is ring-shaped and is positioned in a circular recess in said housing; an adjustment mechanism adapted to rotate said another portion relative to said housing for changing an injection start, said another portion being formed with a recess, said adjustment mechanism including an adjusting lever, a shaft positioned in said housing and connected to said lever and having an axis, and a stop engaged in the recess of said another portion and connected to said shaft, said stop being arranged eccentrically to said axis to form a lever arm, said adjustment mechanism further including an injection adjustment piston connected to said another portion of the cam drive and adjustable in dependence on the speed of the pump; said adjustment mechanism further including a sleeve having a bore, a roller bearing positioned in said bore and supporting said shaft, said housing having a wall formed with a circular recess, said sleeve having a cylindrical portion received in the circular recess of said wall, said cylindrical portion having an axis extending eccentrically with the axis of the shaft, fixing means for connecting said sleeve to the wall of said housing in a respective rotational position of the sleeve, and at least one limiting stop member which defines such a rotational position of said shaft in which said lever arm is in alignment with a circumferential direction of said another portion of said cam drive, said roller bearing being a needle bearing which has an outer ring pressed in said sleeve, said shaft forming an inner ring of said needle bearing, said sleeve having a flange formed with oblong openings, said fixing means including bolts which are guided through said oblong openings, said bolts fixing said sleeve in said housing in an adjusted rotation position.

2. The pump as defined in claim 1, further including a plate formed with said limiting stop member, said plate being connected to said limiting stop member limiting at least one end position of said adjusting lever.

3. The pump as defined in claim 2, wherein said plate is mounted to said flange of said sleeve and is held on said flange by said bolts.

* * * * *